US007811155B2

(12) United States Patent
Sjolander et al.

(10) Patent No.: US 7,811,155 B2
(45) Date of Patent: Oct. 12, 2010

(54) GRINDING MEMBER FOR BUTTONS ON ROCK DRILL BIT

(75) Inventors: Bjorn Sjolander, Burlington (CA); Bo Thomas Sjolander, Oakville (CA); Robert Sjolander, Oakville (CA)

(73) Assignee: CME Blasting & Mining Equipment Ltd., Oakville, Ontario (CA)

( * ) Notice: Subject to any disclaimer, the term of this patent is extended or adjusted under 35 U.S.C. 154(b) by 0 days.

(21) Appl. No.: 12/051,673

(22) Filed: Mar. 19, 2008

(65) Prior Publication Data

US 2008/0207102 A1 Aug. 28, 2008

Related U.S. Application Data

(63) Continuation-in-part of application No. 10/496,195, filed as application No. PCT/CA02/01765 on Nov. 21, 2002, now abandoned.

(30) Foreign Application Priority Data

Nov. 21, 2001 (CA) ..... 2363352

(51) Int. Cl.
*B24B 5/16* (2006.01)

(52) U.S. Cl. ..... 451/270; 451/342; 451/357

(58) Field of Classification Search ..... 451/259, 451/270, 342–359, 448, 450
See application file for complete search history.

(56) References Cited

U.S. PATENT DOCUMENTS

| | | | | |
|---|---|---|---|---|
| 2,656,190 | A * | 10/1953 | Towle | 279/2.03 |
| 5,070,654 | A | 12/1991 | Manqvist et al. | |
| 5,193,312 | A | 3/1993 | Gudmundsson et al. | |
| 5,277,435 | A * | 1/1994 | Kramer et al. | 279/9.1 |
| 5,527,206 | A | 6/1996 | Sjolander et al. | |
| 5,637,037 | A * | 6/1997 | Bergquist | 451/450 |
| 5,639,273 | A | 6/1997 | Sjolander et al. | |
| 5,688,163 | A | 11/1997 | Siden | |
| 5,727,994 | A | 3/1998 | Sjolander et al. | |
| 5,885,136 | A | 3/1999 | Bergqvist | |
| 5,964,649 | A * | 10/1999 | Bergqvist et al. | 451/54 |
| 6,056,628 | A * | 5/2000 | Bergqvist et al. | 451/177 |
| 6,129,619 | A | 10/2000 | Bergqvist | |
| 6,524,166 | B1 * | 2/2003 | Bergquist et al. | 451/28 |
| 6,835,114 | B2 | 12/2004 | Sjolander | |
| 7,083,003 | B1 * | 8/2006 | Pusateri et al. | 173/29 |
| 2003/0141674 | A1 * | 7/2003 | Bobst | 279/7 |
| 2005/0107021 | A1 | 5/2005 | Sjolander et al. | |

FOREIGN PATENT DOCUMENTS

| | | |
|---|---|---|
| SE | 460584 | 10/1989 |
| WO | WO 9325346 A1 | 12/1993 |
| WO | WO 0183164 A1 | 8/2001 |

* cited by examiner

*Primary Examiner*—Maurina Rachuba
(74) *Attorney, Agent, or Firm*—Volpe and Koenig, P.C.

(57) ABSTRACT

The present invention provides a grinding member or connection to a drive connection member to form a grinding cup for grinding the hard metal inserts or working tips of drill bits (percussive or rotary), tunnel boring machine cutters (TBM) and raised bore machine cutters (RBM) to restore them to substantially their original profile, said grinding member having: a. a grinding section having top and bottom surfaces, a centrally disposed convex recess formed in the bottom surface of said grinding section having the desired profile to be ground; b. a support section adjacent the top surface of said grinding section; c. means to connect the grinding member to the drive connection member wherein the grinding member can be disconnected from the drive connection member when it becomes worn.

30 Claims, 2 Drawing Sheets

GRINDING MEMBER FOR BUTTONS ON ROCK DRILL BIT

CROSS REFERENCE TO RELATED APPLICATIONS

This application is a continuation-in-part of U.S. patent application Ser. No. 10/496,195, filed Dec. 21, 2004, which is a 35 U.S.C. §371 application of PCT/CA02/01765, filed Nov. 21, 2002, the contents of which are incorporated by reference as if fully set forth.

BACKGROUND OF THE INVENTION

The present invention relates to improvements in devices for use as grinding cups for grinding the hard metal inserts or working tips of drill bits (percussive or rotary), tunnel boring machine cutters (TBM) and raised bore machine cutters (RBM) and more specifically, but not exclusively, for grinding the tungsten carbide cutting teeth or buttons of a drill bit or cutter.

In drilling operations the cutting teeth (buttons) on the drill bits or cutters become flattened (worn) after continued use. Regular maintenance of the drill bit or cutter by regrinding (sharpening) the buttons to restore them to substantially their original profile enhances the bit/cutter life, speeds up drilling and reduces drilling costs. Regrinding should be undertaken when the wear of the buttons is optimally one third to a maximum of one-half the button diameter.

Different manual and semi-automatic grinding machines are known for grinding button bits/cutters (see for example U.S. Pat. Nos. 5,193,312; 5,070,654). In a conventional type of machine a grinding cup having the desired profile is rotated at high speed, typically from about 15,000 to 25,000 RPM, to grind the carbide button and the face of the bit/cutter surrounding the base of the button to restore the button to substantially its original profile for effective drilling.

The grinding cups conventionally consist of a cylindrical body having top and bottom surfaces. The bottom or working surface consists of a diamond/metal matrix having a centrally disposed convex recess having the desired profile for the button to be ground. The rim around the recess may be adapted, for example by bevelling, to remove steel from the face of the bit around the base of the button.

Water and/or air, optionally with some form of cutting oil, is provided to the grinding surface to flush and cool the surface of the button during grinding.

The grinding cups are provided in different sizes and profiles to match the standard sizes and profiles of the buttons on the drill bits or cutters. Typically the button diameter varies from 6 mm up to 26 mm.

Several different methods are used to connect and retain the grinding cups on to the grinding machine. The grinding cups were conventionally held in the grinding machine by inserting an upright hollow stem projecting from the top surface of the grinding cup into a chuck for detachable mounting of tools. Special tools such as chuck wrenches, nuts and collets are necessary to insert, hold and to remove the grinding cup into and out of the chuck.

To eliminate the need for chuck wrenches etc. the use of a shoulder drive on the grinding cups was developed. A diametrically extending recess at the free end of a hollow drive shaft of the grinding machine co-operates with a shoulder or cam means on the adjacent top surface of the grinding cup. The stem of the grinding cup is inserted into the hollow drive shaft and maybe held in place by one or more O-rings either located in a groove in the interior wall of the drive shaft or on the stem of the grinding cup. See for example Swedish Patent No. B 460,584 and U.S. Pat. No. 5,527,206.

An alternative to the shoulder drive is that shown, for example, in Canadian Patent 2,136,998. The free end of the stem of the grinding cup is machined to provide flat drive surfaces on the stem that are inserted into a corresponding drive part in the channel of the output drive shaft into which the stem is inserted. The grinding cup is retained in place by a spring biased sleeve which forces balls mounted in the wall of the output drive shaft into an annular groove on the stem of the grinding cup.

Other innovations are illustrated in U.S. Pat. Nos. 5,639,273 and 5,727,994. In these patents, the upright stem has been replaced with a centrally disposed cavity provided in the top surface of the grinding cup. The cavity is shaped and sized to permit the output drive shaft of a grinding machine to be inserted into the cavity.

Some manufacturers, in order to provide grinding cups that are compatible for use with other manufacturers' grinding machines provide adapters that connect their grinding cup to the output drive shaft of competitors' grinding machines.

Regardless of the method of connecting the grinding cup to the output drive shaft of the grinding machine, it is important to optimize the operational stability of the grinding cup. Lack of operational stability often results in vibration and resonance during grinding. Vibration and/or resonance also directly results in increased rates of wear to all moving parts such as bearings, joints, etc. of the grinding apparatus and can potentially interfere with settings within the operating control circuits of the grinding apparatus. In addition, lack of operational stability results in increased wear to all key drive/contact surfaces of the output drive shaft (rotor) and grinding cup which provide consistent, proper alignment between grinding cup and or adapter and the rotor during operation. Operational instability and associated vibration and/or resonance is a major contributor to the deterioration of the preferred built-in profile of the cavity in the grinding section of the grinding cup. This directly results in deterioration in the profile of the restored button. The net effect being a substantial loss in the intended overall drilling performance of the drill bit or cutter used.

The grinding cups are conventionally manufactured by first forming a blank for the body section by machining, casting, forging etc. It is necessary to machine different blanks for each size of button to be ground and for the different methods of attaching the grinding cup to the grinding machine. This results in higher costs of manufacture and a large inventory of parts for manufacture of the grinding cups over the full range of sizes, shapes and methods of connection. The blank is then pressed into a mould containing a hot diamond/metal mixture. The bottom surface of the blank is heated and bonds to the diamond/metal matrix. Several means of heating and bonding the diamond/metal matrix to the blank are known. Alternatively the diamond/metal matrix can be formed into the grinding section and then bonded either by a shrink fit and/or with adhesives or solder to a blank.

SUMMARY OF THE INVENTION

It is an object of the present invention to standardize components regardless of the size of the button to be ground or method of connection to reduce manufacturing costs. Standardized components can be manufactured in relatively large quantities and then used to assemble grinding cups according to the present invention.

It is a further object of the present invention to provide a standardized grinding member for each size and shape of button to be ground that can be custom connected to different or re-useable drive means.

It is an object of the present invention to reduce negative impact on operational stability, drive/contact surface wear/damage, wear/damage and/or deformation of materials in the drive and/or contact areas, as well as other potential associated wear/damage to the grinding apparatus caused by vibration and/or resonance.

It is a further object of the present invention to improve operational stability by optimizing/harmonizing the forces transferred between the rotor and grinding cup or grinding cup and adapter or adapter and rotor during operation including torsion (rotational) forces, axial (feed) forces and radial (varying side load) forces.

It is a further object of the present invention to optimize the alignment between the grinding member and drive connection member.

Accordingly the present invention provides a grinding member for connection to a drive connection member for grinding the hard metal inserts or working tips of drill bits (percussive or rotary), tunnel boring machine cutters (TBM) and raised bore machine cutters (RBM) to restore them to substantially their original profile. The grinding member has:

(a) a grinding section having top and bottom surfaces, a centrally disposed convex recess formed in the bottom surface of said grinding section having the desired profile to be ground;

(b) a support section adjacent the top surface of said grinding section; and (c) means to connect the grinding member to the drive connection member wherein the grinding member can be disconnected from the drive connection member when it becomes worn.

In a preferred embodiment the means to connect the grinding member to the drive connection member drive consists of a longitudinally extending stub adapted to fit in a corresponding recess on said drive connection member.

In another aspect the present invention provides a drive connection member having a first section adapted for connection to the grinding member and a second section adapted to detachably connect to the output drive shaft of a grinding machine. The second section consists of a drive section and a support section and preferably has engagement surfaces sized and shaped to substantially match contact areas on the output drive shaft of the grinding machine or any adapter connecting said drive connection member to the output drive shaft of a grinding machine.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF PREFERRED EMBODIMENTS

Figure 1:
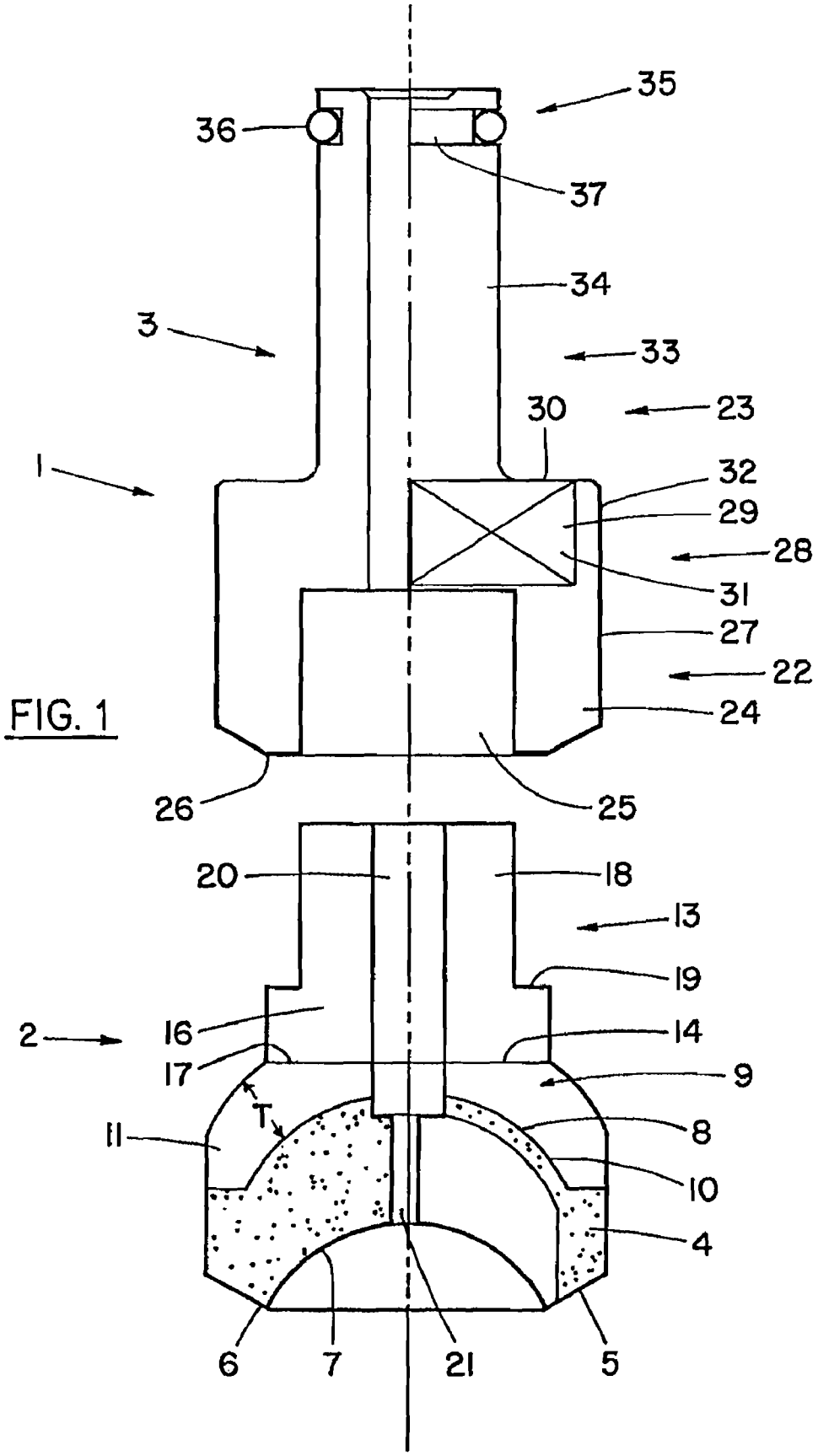
FIG. 1 is a side elevation, partly in section, of an embodiment of a grinding member and a drive connection member utilizing a shoulder drive according to the present invention.

The present invention is illustrated in FIG. 1 in conjunction with grinding cups utilizing a shoulder drive but is also applicable to other types of drive means on grinding cups.

Referring to FIG. 1, one embodiment of a grinding cup according to the present invention is generally indicated at 1. The grinding cup 1 is for use with a grinding machine of the type which incorporates a diametrically extending slot at the free end of the output drive shaft of the grinding machine that co-operates with a shoulder or cam means on the adjacent top surface of the grinding cup such as described in U.S. Pat. No. 5,527,206.

The grinding cup 1 is formed of two distinct components: a grinding member 2 and drive connection member 3. The grinding member 2 has a grinding section 4 formed from a material capable of grinding the tungsten carbide inserts of button bits. In the preferred embodiment, the grinding section 4 is formed from a metal and diamond matrix. The peripheral edge 5 in the bottom surface 6 of the grinding section 4 is preferably beveled to facilitate the removal of steel from the face of the bit around the base of the button during grinding. Other means for removal of steel from the face of the bit around the base of the button either during or before or after grinding are known including the use a separate tool for this purpose, use of wear splines or broach marks around the periphery or varying the angle of the peripheral edge. A centrally disposed convex recess 7 is formed in the bottom surface 6 having the desired size and profile for the button to be ground.

Preferably integral with and adjacent the top surface 8 of the grinding section 4 is a support section 9 whose bottom surface 10 is bound to the top surface 8 of the grinding section 4. Several means of heating and bonding the diamond/metal matrix of the grinding section 4 to support section 9 are known. The support section 9 consists of a metal portion 11, machined, forged or cast. The metal portion 11 for the support section 9 can be machined either before or after it is attached to diamond/metal grinding section 4. while the portion 11 is referred to as being made of metal in the preferred embodiment, the present invention can include the use of non-metallic materials or a combination of non-metallic and metallic materials to form support section 9 and portion 11. The preferred procedure would be to the extent possible pre-machine the support section 9 before attaching the grinding section 4. Alternatively the grinding section 4 and support section 9 can be formed at the same time. In any event some form of post-furnace machining may be required for clean up purposes. Clean up of the exterior surfaces post-furnace is carried out by holding the grinding section 4 in the chuck of a lathe and then skimming the relevant surfaces wherever needed. At this time it is also possible to remove additional material wherever suitable. Post-furnace machining is used to remove "flash" and other matrix material which may have seeped out of the mold during furnacing/pressing. The thickness T of the metal portion 11 of the support section 9 should be sufficient to provide structural support for the grinding section 4.

Means 13 to connect the grinding member 2 to the drive connection member 3 are provided on the top edge 14 of the support section 9. The means 13 to connect the grinding member 2 to the drive connection member 3 can be formed integrally with the support section 9 and machined to the desired configuration or cast separately and attached to the support section 9. In the embodiment illustrated in FIG. 1, the diameter of the support section 9 relative to the size of the grinding section 4 is optimized to reduce the mass of the grinding member 2 by machining the peripheral surface 15 to its top edge 14 in a profile generally corresponding to the profile of the top surface 8 of the grinding section 4.

In the embodiment illustrated in FIG. 1, the means 13 to connect the grinding member 2 to the drive connection member 3, consists of a generally cylindrical section 16 whose bottom edge 17 is attached and/or with the top edge 14 of support section 9. A cylindrical stub 18 is centrally located on the top edge 19 of the cylindrical section 16. The stub 18 is intended to be inserted into a corresponding cavity on the drive connection member 3 in a manner (1) that will prevent the grinding member 2 from rotating or spinning free relative to the drive connection member 3; (2) that will support axial, radial, torsion and feed forces associated with the use of the grinding cup and (3) optionally permit removal of a grinding member 2 with worn grinding section 2 and replacement with a new grinding member to permit re-use of the drive connection member. In the preferred embodiment illustrated the stub 18 is press fit into the drive connection member. Alternatively a stub on the drive connection member could fit into a corresponding cavity on the grinding member. Some examples of other possible connection methods are taper fits, threaded connections, adhesives, solder, friction welding and pins. Preferably the connection method permits the grinding member 2 to be disconnected from the drive connection member 3 only by the factory and not the end user. Accordingly connection methods would be preferably be selected from press fit, shrink fit, some adhesives, solder, or possibly friction welding as these methods are not likely to permit disconnection by the end user which would be the case for threaded connections or the use of pins.

A passageway 20 through the grinding member 2 connects to one or more outlets 21 in the grinding section 4 to permit a coolant, preferably water, optionally mixed with cutting oil or a water/air mist, to be provided to the surface of the button during grinding. The coolant prevents excessive heat generation during grinding and flushes the surface of the button of material removed during grinding. In addition, the diameter of the passageway 20 through the support section 9 and means 13 may be expanded to reduce the mass of the grinding section.

In the present invention the grinding member 2 for any particular size and shape of convex recess 7 is the same regardless of the method of connecting the grinding cup to the output drive shaft of a grinding machine. Standardizing the components will reduce manufacturing costs and the amount of inventory required.

The drive connection member 3 in the embodiment illustrated in FIG. 1 is illustrated as a separate component to be connected to the output drive shaft of a grinding machine utilizing one of the known drive methods identified previously. The drive connection member in FIG. 1 has a first section 22 adapted for connection to the grinding member 2 and a second section 23 adapted to detachably connect to the output drive shaft of a grinding machine. The first section 22, in the embodiment illustrated the outer wall 24 of first section 22, generally cylindrical in the embodiment shown although other shapes are possible, defines a recess 25 adapted to receive the stub 18 of the grinding member 2. The stub 18 is adapted to fit within recess 25 so that the grinding member 2 cannot rotate or spin relative to the drive connection member 3. The bottom 26 of the outer wall 24 is sized and shaped to fit against the top edge 19 of the cylindrical section 16 of means 13 on the grinding member 2. While the stub 18 and recess 25 are illustrated as circular in cross section other shapes are possible such as elliptical, oval, square, rectangular, hexagonal etc. As noted previously it is within the scope of the present invention to have a stub on the drive connection member fit within a recess on the grinding member.

The second section 23 of the drive connection member is integral with the top 27 of the outer wall 24 of the first section. The configuration of the second section 23 will vary depending on the drive system on the grinding machine to which the grinding cup is intended to be attached. Regardless of the drive system being utilized, in general the second section 23 will have a drive section and a support section. In FIG. 1 the drive system to which the drive connection member 3 is intended to co-operate is a shoulder drive system. In the illustrated embodiment the drive section, generally indicated at 28, cam means or shoulder 29 provided at the top 27 of the outer wall 24 of the first section 22. The cam or shoulder 29 is sized to engage with a diametrically extending slot at the free end of the output drive shaft of a grinding machine. The cam 29 has an upper surface 30, parallel side walls 31 and end walls 32. The support section, generally indicated at 33, consists of a hollow vertical upright stem 34 centrally located on the upper surface 30 of the cam 29. The hollow stem 34 is intended to be inserted into a corresponding axial recess in the output shaft of the grinding machine. Retaining means 35 are provided in conjunction with the upright stem 34 to releasably secure the grinding cup to the output shaft of the grinding machine during use. In the preferred embodiment illustrated in FIG. 1, the retaining means 35 are one or more O-rings 36 located in one or more grooves 37 on the stem 34. Optionally the retaining means could also be located on the output drive shaft or a combination on both the grinding cup and the drive shaft working independently or cooperatively.

In the embodiment shown, the drive section 27 is adapted to optimize contact between the engagement surfaces (upper surface 30 and side walls 31 of cam 29) on the drive connection member 3 and the corresponding engagement surfaces on the output drive shaft of the grinding machine to reduce vibration to reduce rotor wear, as well as other potential associated wear to the grinding apparatus caused by vibration and/or resonance and to improve operational stability by optimizing and harmonizing the forces transferred between the rotor and grinding cup during operation including torsion (rotational) forces, axial (feed) forces and radial (varying side load) forces and to reduce negative impact on operational stability, drive/contact surface wear/damage, wear/damage and/or deformation of materials in the drive and/or contact areas.

In the embodiment shown, cam means or shoulder 29 is sized and shaped so that the engagement surfaces on said cam or shoulder are optimized to and match with the corresponding engagement surfaces of slot on the output shaft of the grinding machine. In addition the cam or shoulder 29 is preferably substantially the same length, width and depth as the diametrically extending slot at the free end of the output drive shaft of the grinding machine. This optimizes the contact area between the walls of slot on the drive shaft and the upper surface 30 and side walls 32 of the cam 29 resulting in reduced vibration and rotor wear, as well as other potential associated wear to the grinding apparatus caused by vibration and/or resonance. Reduced vibration also improves operational stability, drive/contact surface wear/damage, wear/damage and/or deformation of materials in the drive and/or contact areas by optimizing and harmonizing the forces transferred between the rotor and grinding cup during operation including torsion (rotational) forces, axial (feed) forces and radial (varying side load) forces. In addition, substantially reducing vibration and/or resonance, minimizes the deterioration of the preferred built-in profile of the cavity in the grinding section.

To optimize and harmonize the various loads such as torsion loads and resulting operational loads such as radial and axial loads over a range of various sizes and profiles of grinding cups, the cam or shoulder may be sized differently in relation to the diametrically extending slot at the free end of the output drive shaft or adaptor if one is being used.

The above noted methods to optimize the contact area between the drive shaft and the grinding cup and standardize components, wherever practical, regardless of the size of the button to be ground will reduce manufacturing costs. In addition, this results in less vibration to reduce rotor wear, as well as other potential associated wear to the grinding apparatus caused by vibration and/or resonance and reduces negative impact on operational stability, drive/contact surface wear/damage, wear/damage and/or deformation of materials in the drive and/or contact areas by optimizing and harmonizing the forces transferred between the rotor and grinding cup during operation including torsion (rotational) forces, axial (feed) forces and radial (varying side load) forces. In addition, deterioration of the preferred built-in profile of the cavity in the grinding section is minimized. Consideration is given to the size of the grinding cup, the drive means selected, manufacturing costs, materials of construction, areas required for product identification and necessary structural strength and/or support in implementation of the present invention.

Alternative manufacturing methods in order to achieve further standardization, simplify manufacturing, reduce costs and minimize inventory are within the scope of the present invention. Alternative materials (both metallic and non-metallic or a combination thereof) and processes can be used that are currently incompatible with any one or more parts or the manufacturing process. For example, brass is not normally compatible with many forms of sintering, etc., due to the fact that it cannot take the heat necessary to produce a good bond within the diamond matrix of the grinding section. Making a separate drive connection member out of brass and attaching the grinding member, post furnace, would make this possible. Heat treating the drive connection member may not feasible when done on a finished grinding cup, but on a re-useable one, it may be both operationally beneficial and cost efficient for the user. Non-metallic materials, such as plastics, polymers or elastomeric material and the like, can be used in mating surfaces between the grinding member and the drive connection member and or drive connection member and the output drive shaft or adapter. Non-metallic materials can be selected to provide anti-wear characteristics, provide anti-vibration characteristics or allow mating surfaces to be more forgiving when dirt is present, potentially reducing problems within the mating sections. Similarly the components of the grinding member and drive connection member can be made from metallic or non-metallic materials or a combination of both in order to facilitate use of alternative manufacturing methods such as injection molding, casting, powder metallurgy etc to make some of the components at a lower cost.

Since a standardized drive connection member according to the present invention, can be mass produced, the advantage of higher precision, reduced cost, etc. are possible by the category of machining equipment available to make this component. Further by making a standardized drive connection member with greater precision could result in better dynamic balance, etc. due to factors such as less runout, etc. Any other components that can be standardized can be manufactured in relatively large scale and then used to assemble grinding cups according to the present invention.

Figure 2:
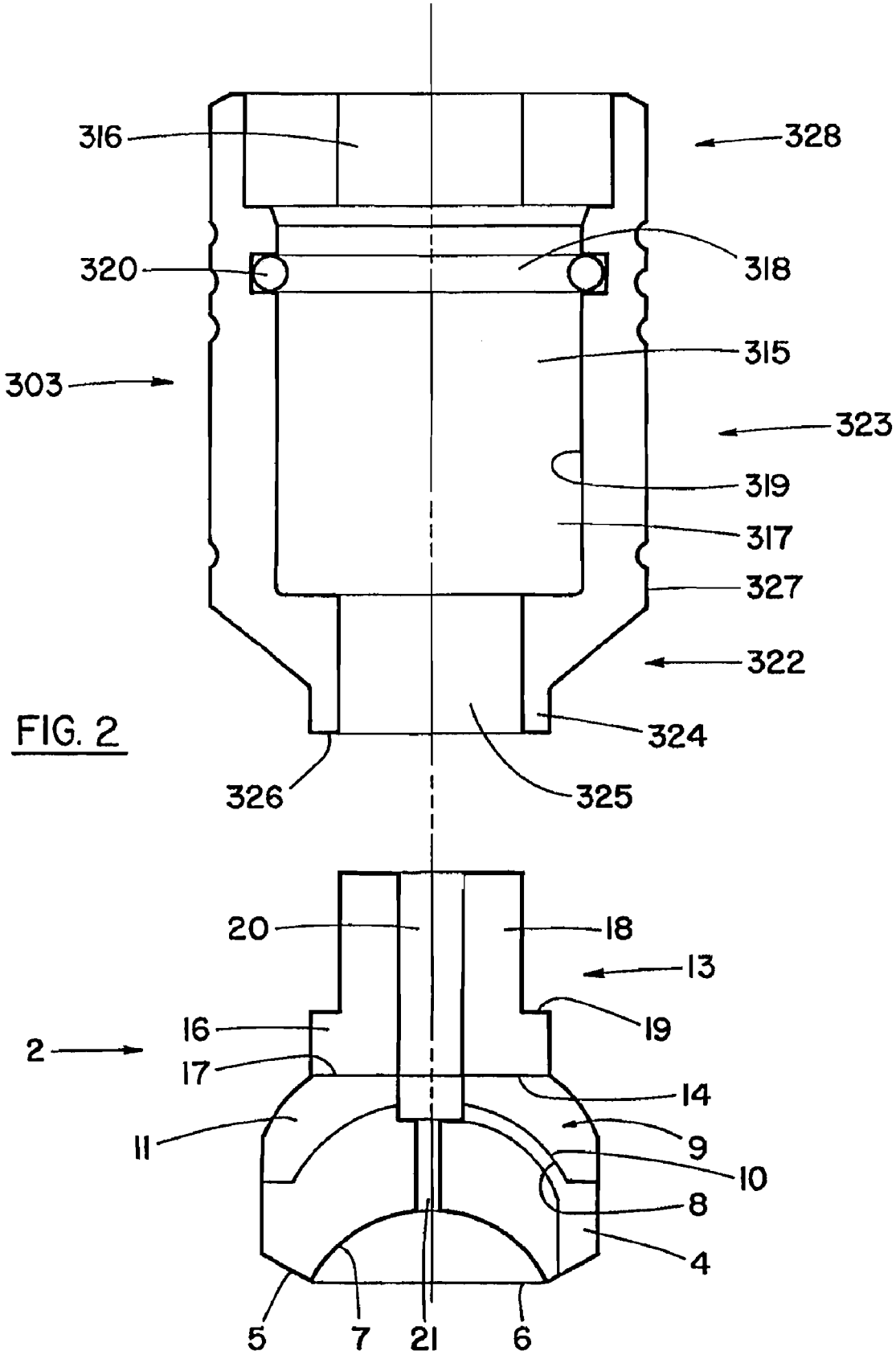
FIG. 2 is a side elevation, partly in section, of an embodiment of a grinding member and another drive connection member utilizing a hex drive according to the present invention.

FIG. 2 illustrates a grinding cup formed from two components a grinding member and drive connection member for connection to grinding machine utilizing a hex drive system as illustrated in U.S. Pat. No. 5,727,994. The grinding member 2 is the same as described above in connection with FIG. 1. The drive connection member generally indicated at 303 in the embodiment illustrated in FIG. 2 has a first section 322 adapted for connection to the grinding member 2 and a second section 323 adapted to detachably connect to the output drive shaft of a grinding machine. The first section 322, in the embodiment illustrated the outer wall 324 of first section 322 defines a recess 325 adapted to receive the stub 18 of the grinding member 2. The stub 18 is adapted to fit within recess 325 so that the grinding member 2 cannot rotate or spin relative to the drive connection member 303. The bottom 326 of the outer wall 324 is sized and shaped to fit against the top edge 19 of the cylindrical section 16 of means 13 on the grinding member 2. Alternatively a stub on the drive connection member could fit into a corresponding cavity on the grinding member. Other possible connection methods are taper fits, threaded connections, adhesives, solder, friction welding and pins.

The second section 323 of the drive connection member 303 is integral with the top 327 of the outer wall 324 of the first section. The configuration of the second section 323 will vary depending on the drive system on the grinding machine to which the grinding cup is intended to be attached. Regardless of the drive system being utilized, in general the second section 323 will have a drive section and a support section. In FIG. 2 as previously indicated the drive system to which the drive connection member 303 is intended to co-operate is a hex drive system. In the illustrated embodiment the drive section, generally indicated at 328, is intended to cooperate with the output shaft of the grinding machine. In the embodiment illustrated in FIG. 2, the second section 323 has a outer wall 304 defining a centrally disposed cavity 315 open at the top 305 of the outer wall 304. This cavity 315 is shaped and sized to permit the drive connection member 303 to be detachably connected to the output drive shaft of the grinding machine and rotated during the grinding operation. The end portion of the output drive shaft is adapted to fit within the corresponding sized centrally disposed cavity 315. The output drive shaft is adapted to driveably engage within cavity 315. In the preferred embodiment shown the top portion 316 of cavity 315 in second section 323 is adapted to define drive section 328. In the embodiment shown, drive section 328 is machined with a hexagonal cross section corresponding to the shape of the corresponding drive section on the output shaft of the grinding machine. The drive section 328 can be formed other than by machining. To provide support for the grinding cup and minimize vibration generated axial side load on the grinding cup, the free end of the output drive shaft is adapted to fit snugly within the bottom portion 317 of cavity 315 in the second section 323 of the drive connection member 303. In the embodiment illustrated, both the free end of the output drive shaft and the bottom portion 317 of cavity 315 would have a circular cross section slightly smaller in diameter than the hexagonal drive section 328. Other arrangements are possible, for example the support section of the cavity can be above the drive section located at the bottom of the cavity or the drive section can be located intermediate two support sections.

Retaining means are provided on either the output drive shaft or in the cavity 315 or a combination of both to detachably retain the grinding cup so that grinding cup will not fly off during use but can still be easily removed or changed after use. As noted previously the specific means of connecting and retaining the drive connection member to the output drive shaft may vary to match any of the existing drive systems known in the prior art or any new standardized or customized drive systems developed. For example in the embodiment shown in FIG. 2 a groove 318 is provided in the wall 319 of cavity 315 into which an O-ring 320 is placed. The O-ring 320 will co-operate with the exterior surface of the output drive shaft to assist in retaining the grinding cup in place during use and reducing vibration and resonance. Additional O-rings on the output drive shaft will co-operate with the wall 319 of the bottom portion 317 of cavity 315 and O-ring 320 to retain the grinding cup in place during use. These grooves and O-rings are points of engagement which work to optimize the transfer of loads between the adapter and the output drive shaft.

In the embodiment shown, the drive connection member 303 is adapted to optimize the engagement or drive surfaces on the drive section 328 of the grinding cup with the corresponding contact surfaces on the output drive shaft to reduce vibration to thereby reduce rotor wear, as well as other potential associated wear to the grinding apparatus caused by vibration and/or resonance and to improve operational stability by optimizing and harmonizing the forces transferred between the rotor and grinding cup during operation including torsion (rotational) forces, axial (feed) forces and radial (varying side load) forces. Reduced vibration also improves operational stability, drive/contact surface wear/damage, wear/damage and/or deformation of materials in the drive and/or contact areas by optimizing and harmonizing the forces transferred between the rotor and grinding cup during operation including torsion (rotational) forces, axial (feed) forces and radial (varying side load) forces. In addition, substantially reducing vibration and/or resonance, minimizes the deterioration of the preferred built-in profile of the cavity in the grinding section.

To further reduce vibration and improve operational stability, drive/contact surface wear/damage, wear/damage and/or deformation of materials in the drive and/or contact areas by optimizing and harmonizing the forces transferred between the rotor and grinding cup during operation including torsion (rotational) forces, axial (feed) forces and radial (varying side load) forces, it is possible to utilize lighter weight materials such as metallic or non-metallic materials in the grinding member or drive connection member or to form part of the drive means or retaining means. Non-metallic materials, such as plastics, polymers or elastomeric material and the like, can be used in mating surfaces between the dive member and the drive connection member and or drive connection member and the output drive shaft or adapter. Non-metallic materials can be selected to provide anti-wear characteristics, provide anti-vibration characteristics or allow mating surfaces to be more forgiving when dirt is present, potentially reducing problems within the mating sections. Similarly the components of the grinding member and drive connection member can be made from metallic or non-metallic materials or a combination of both in order to facilitate use of alternative manufacturing methods such as injection moulding, casting, powder metallurgy etc to make some of the components at a lower cost.

The grinding cups of the present invention are intended to reduce manufacturing costs by standardizing components and reducing inventory on hand. However they also may have a number of features directed to (1) optimizing the drive surface on the drive means to prevent uneven wear and further reduce vibration to optimize the drive and/or contact surfaces on the drive means of a grinding cup relative to the corresponding drive and/or contact surfaces of the grinding apparatus rotor/adapter to prevent uneven wear and reduce vibration (2) reduce negative impact on wear/damage and/or deformation of materials in drive and/or contact areas (3) improving operational stability by optimizing/harmonizing the forces transferred between the rotor and grinding cup during operation including torsion (rotational) forces, axial (feed) forces and radial (varying side load) forces (4) minimizing operator exposure to sharp and/or protruding features when the grinding cup and rotor have engaged (5) substantially streamline/harmonize all contact surfaces including the combined outside geometry at the transition point between grinding cups and rotor/adapter and (6) reducing the mass of the grinding cups by reducing the outside and inside profile of the grinding cup and/or using lighter weight materials.

Having illustrated and described a preferred embodiment of the invention and certain possible modifications thereto, it should be apparent to those of ordinary skill in the art that the invention permits of further modification in arrangement and detail. For example the grinding cup may include an adapter to connect the grinding cup of one drive system to the output drive shaft of a different drive system. As an alternative to forming a grinding cup for attachment to the output drive shaft using known drive systems, the drive connection member can be a separate section of the output drive shaft. The drive connection member could be connected directly to the output drive shaft, by a threaded or other suitable detachable connection, that will provide proper alignment between components.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed is:

1. A grinding cup in a series of grinding cups, each grinding cup in the series comprising a different size and profile, for grinding hard metal inserts or working tips of drill bits (percussive or rotary), tunnel boring machine cutters (TBM), and raised bore machine cutters (RBM) to restore them to substantially their original profile, wherein said working tips have a diameter of about 6 mm to 26 mm, each of said grinding cups in the series having a replaceable lower grinding member with a centrally disposed convex recess formed in a bottom surface of said grinding cup, said recess having a size and desired profile of the working tip to be ground and a re-useable upper drive connection member adapted to detachably connect to an output drive shaft of a grinding machine and standardized across a plurality of profiles and sizes of working tips to be ground, said grinding member having a grinding section having top and bottom surfaces, the centrally disposed convex recess being formed in the bottom surface of said grinding section and a support section adjacent the top surface of said grinding section and said grinding member including means to connect the grinding member to the drive connection member, and said upper drive connection member having a first section adapted for connection to said grinding member and a second section adapted to detachably connect to an output drive shaft of a grinding machine, wherein the means to connect the grinding member to the drive connection member is selected from the group consisting of a press fit, shrink fit, adhesive, solder, and friction welding such that the grinding member can be disconnected only by a manufacturer from the drive connection member when it becomes worn to permit the drive connection member to be attached to another grinding member.

2. A grinding cup according to claim 1, wherein the means to connect the grinding member to the drive connection member comprises a longitudinally extending stub on a top surface of the support section of the grinding member and wherein the first section of said drive connection member has an outer wall that defines a recess adapted to receive said stub on the grinding member.

3. A grinding cup according to claim 2, wherein the second section of said drive connection member has engagement surfaces sized and shaped to substantially match contact areas on the output drive shaft of the grinding machine or any adapter connecting said drive connection member to the output drive shaft of a grinding machine.

4. A grinding cup according to claim 1, wherein said second section of the drive connection member comprises a drive section and a support section.

5. A grinding cup according to claim 2, wherein said second section of the drive connection member comprises a drive section and a support section.

6. A grinding cup according to claim 4, wherein said drive section of the drive connection member comprises cam means sized to engage with a diametrically extending slot in said output drive shaft, said cam means having an upper surface, opposite side walls, and end walls, wherein said support section comprises a hollow vertical upright stem centrally located on the upper surface of the cam means.

7. A grinding cup according to claim 1, wherein non-metallic materials are used on the contact surfaces between the drive connection member and the grinding member.

8. A grinding cup according to claim 2, wherein non-metallic materials are used on the contact surfaces between the drive connection member and the grinding member.

9. A grinding cup according to claim 3, wherein non-metallic materials are used on the contact surfaces between the drive connection member and the grinding member.

10. A grinding cup according to claim 4, wherein non-metallic materials are used on the contact surfaces between the drive connection member and the grinding member.

11. A grinding cup according to claim 1, wherein non-metallic materials are used on the contact surfaces between the drive connection member and the output drive shaft.

12. A grinding cup according to claim 2, wherein non-metallic materials are used on the contact surfaces between the drive connection member and the output drive shaft.

13. A grinding cup according to claim 3, wherein non-metallic materials are used on the contact surfaces between the drive connection member and the output drive shaft.

14. A grinding cup according to claim 4, wherein non-metallic materials are used on the contact surfaces between the drive connection member and the output drive shaft.

15. A grinding cup according to claim 1, wherein the drive connection member and grinding member are connected to provide alignment between the convex recess in the grinding section of the grinding member and the first and second sections of the drive connection member.

16. A grinding cup according to claim 2, wherein the drive connection member and grinding member are connected to provide alignment between the convex recess in the grinding section of the grinding member and the first and second sections of the drive connection member.

17. A grinding cup according to claim 3, wherein the drive connection member and grinding member are connected to provide alignment between the convex recess in the grinding section of the grinding member and the first and second sections of the drive connection member.

18. A grinding cup according to claim 4, wherein the drive connection member and grinding member are connected to provide alignment between the convex recess in the grinding section of the grinding member and the first and second sections of the drive connection member.

19. A grinding cup according to claim 1, wherein the drive connection member is manufactured from materials not compatible with the manufacturing process of the grinding member.

20. A grinding cup according to claim 2, wherein the drive connection member is manufactured from materials not compatible with the manufacturing process of the grinding member.

21. A grinding cup according to claim 3, wherein the drive connection member is manufactured from materials not compatible with the manufacturing process of the grinding member.

22. A grinding cup according to claim 9, wherein the drive connection member is manufactured from non-metallic materials.

23. A method of making a grinding cup in a series of grinding cups comprising:

providing a series of grinding cups, each grinding cup in the series having a different size and profile, for grinding hard metal inserts or working tips of drill bits (percussive or rotary), tunnel boring machine cutters (TBM), and raised bore machine cutters (RBM) to restore them to substantially their original profile, wherein the working tips have a diameter of about 6 mm to 26 mm, providing each of the grinding cups in the series with a replaceable lower grinding member, forming a centrally disposed convex recess in a bottom surface of the grinding cup, the recess having a size and desired profile of the working tip to be ground and a re-useable upper drive connection member adapted to detachably connect to an output drive shaft of a grinding machine and standardized across a plurality of profiles and sizes of working tips to be ground, forming a grinding section having top and bottom surfaces on the grinding member, the centrally disposed convex recess being formed in the bottom surface of the grinding section and a support section adjacent the top surface of the grinding section, providing a means to connect the grinding member to the drive connection member, providing said upper drive connection member with a first section adapted for connection to said grinding member and a second section adapted to detachably connect to an output drive shaft of a grinding machine, and attaching the grinding member to the connecting member by at least one of a press fit, shrink fit, adhesive, solder, or friction weld, wherein the grinding member can be disconnected only by a manufacturer from the drive connection member when it becomes worn to permit the drive connection member to be attached to another grinding member.

24. A grinding cup in a series of grinding cups, each grinding cup in the series comprising a different size and profile, for grinding hard metal inserts or working tips of drill bits (percussive or rotary), tunnel boring machine cutters (TBM), and raised bore machine cutters (RBM) to restore them to substantially their original profile, wherein said working tips have a diameter of about 6 mm to 26 mm, each of said grinding cups in the series having a replaceable lower grinding member with a centrally disposed convex recess formed in a bottom surface of said grinding cup, said recess having a size and desired profile of the working tip to be ground and a re-useable upper drive connection member adapted to detachably connect to an output drive shaft of a grinding machine and standardized across a plurality of profiles and sizes of working tips to be ground, said grinding member having a grinding section having top and bottom surfaces, the centrally disposed convex recess being formed in the bottom surface of said grinding section and a support section adjacent the top surface of said grinding section and said grinding member including means to connect the grinding member to the drive connection member, and said upper drive connection member having a first section adapted for connection to said grinding member and a second section adapted to detachably connect to an output drive shaft of a grinding machine, wherein the grinding member and the drive connection member are connected by means of a press fit, shrink fit, adhesive, solder, or friction welding so the grinding member can be disconnected only by a manufacturer from the drive connection member when it becomes worn to permit the drive connection member to be attached to another grinding member.

25. A grinding cup according to claim 1, wherein the means to connect the grinding member to the drive connection member comprises a press fit formed between a portion of the grinding member and a portion of the drive connection member.

26. A grinding cup according to claim 1, wherein the means to connect the grinding member to the drive connection member comprises a shrink fit formed between a portion of the grinding member and a portion of the drive connection member.

27. A grinding cup according to claim 1, wherein the means to connect the grinding member to the drive connection member comprises an adhesive applied between a portion of the grinding member and a portion of the drive connection member.

28. A grinding cup according to claim 1, wherein the means to connect the grinding member to the drive connection member comprises soldering a portion of the grinding member to a portion of the drive connection member.

29. A grinding cup according to claim 1, wherein the means to connect the grinding member to the drive connection member comprises friction welding a portion of the grinding member to a portion of the drive connection member.

30. A method for manufacturing a grinding cup in a series of grinding cups, each grinding cup in the series comprising a different size and profile, for grinding hard metal inserts or working tips of drill bits (percussive or rotary), tunnel boring machine cutters (TBM), and raised bore machine cutters (RBM) to restore them to substantially their original profile, wherein said working tips have a diameter of about 6 mm to 26 mm, each of said grinding cups in the series having a replaceable lower grinding member with a centrally disposed convex recess formed in a bottom surface of said grinding cup, said recess having a size and desired profile of the working tip to be ground and a re-useable upper drive connection member adapted to detachably connect to an output drive shaft of a grinding machine and standardized across a plurality of profiles and sizes of working tips to be ground, said grinding member having a grinding section having top and bottom surfaces, the centrally disposed convex recess being formed in the bottom surface of said grinding section and a support section adjacent the top surface of said grinding section and said grinding member including means to connect the grinding member to the drive connection member, and said upper drive connection member having a first section adapted for connection to said grinding member and a second section adapted to detachably connect to an output drive shaft of a grinding machine, wherein the grinding member is disconnected from the drive connection member when it becomes worn and then attaching a new grinding member to the drive connection member.

* * * * *